United States Patent [19]

Kikuta

[11] Patent Number: 4,699,438

[45] Date of Patent: Oct. 13, 1987

[54] LOCKING MECHANISM FOR ELECTRICAL CONNECTOR

[75] Inventor: Shigeru Kikuta, Tokyo, Japan

[73] Assignee: Hirose Electric Co., Ltd., Tokyo, Japan

[21] Appl. No.: 893,706

[22] Filed: Aug. 6, 1986

[30] Foreign Application Priority Data

Nov. 28, 1985 [JP] Japan ..... 60-268141
Nov. 28, 1985 [JP] Japan ..... 60-183327[U]

[51] Int. Cl.[4] ..... H01R 13/639

[52] U.S. Cl. ..... 439/95; 439/353; 439/607

[58] Field of Search ..... 339/91 R, 14 R, 143 R

[56] References Cited

U.S. PATENT DOCUMENTS

| | | | |
|---|---|---|---|
| 1,835,251 | 12/1931 | Wetstein | 339/91 R |
| 1,899,360 | 2/1983 | Roudebush et al. | 339/91 R |
| 2,760,174 | 8/1956 | Burtt et al. | 339/91 R |
| 3,329,925 | 7/1967 | Johnson et al. | 339/91 R |
| 3,398,390 | 8/1968 | Long | 339/91 R |
| 3,566,336 | 2/1971 | Johnson et al. | 339/91 R |
| 4,460,230 | 7/1984 | McKee et al. | 339/91 R |
| 4,619,493 | 10/1986 | Kikuta | 339/143 R |

FOREIGN PATENT DOCUMENTS 62362 6/1968 German Democratic Rep. ... 339/91 R

OTHER PUBLICATIONS

IBM Technical Disclosure Bulletin, vol. 16, No. 12, May 1974, "Spring Retainer", Evans, R. T.

*Primary Examiner*—John McQuade
*Attorney, Agent, or Firm*—Yusuke Takeuchi

[57] ABSTRACT

A mechanism for locking the connection between a first electrical connector having a first insulating housing with contacts arranged therein and a conducting connector case surrounding said insulating housing and a second electrical connector having a second insulating housing with contact arranged therein. It comprises a locking member extending along at least one side of said first electrical connector between said insulating housing and said conducting case; a first connection member fitted between said insulating housing and said locking member for protecting said locking member against physical damage and electronic equipment against electrostatic damage; a second connection member provided on the insulating housing side of said second electrical connector corresponding to said first connector side on which said locking member and the connection member are mounted.

15 Claims, 21 Drawing Figures

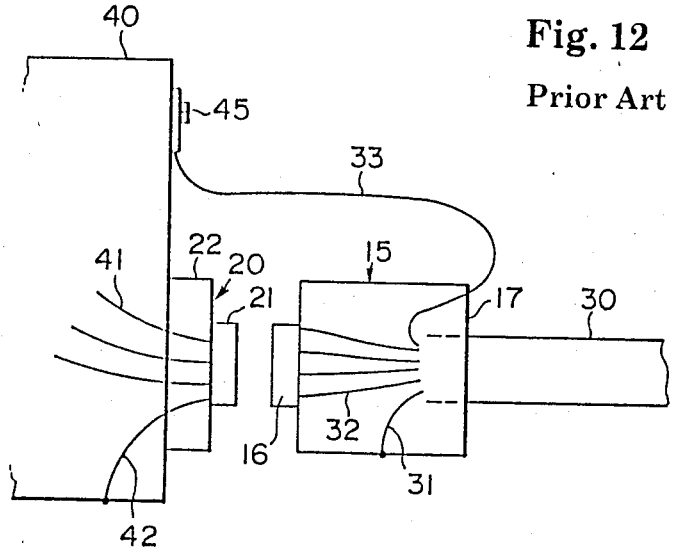
Fig. 12
Prior Art
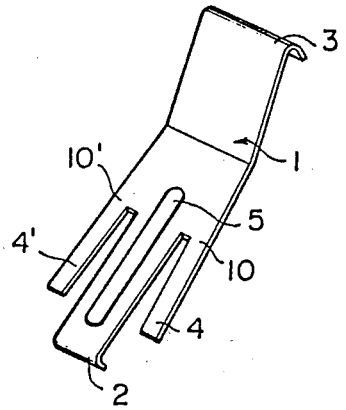
Fig. 13
Prior Art
Fig. 14 Prior Art
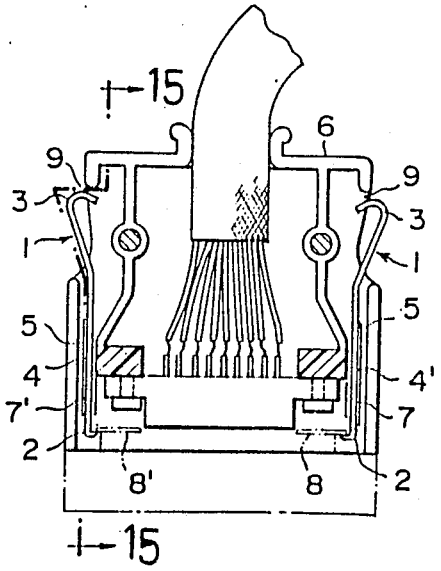
Fig. 15 Prior Art
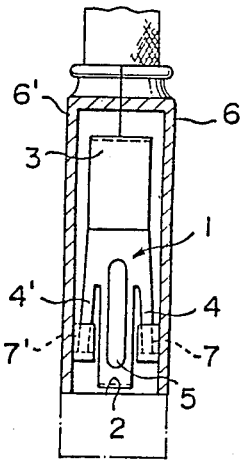

LOCKING MECHANISM FOR ELECTRICAL CONNECTOR

BACKGROUND OF THE INVENTION

1. Field of the Invention

The present invention relates to a locking mechanism for electrical connectors, more especially to a locking mechanism for electrical connectors having a conductive connector case.

2. Description of the Prior Art

Most of the latest electronic systems having a computer precision electronic circuit require some protection against electrostatic damage. Especially, precision electronic circuits having an IC or LSI are prone to electrostatic damage, causing a malfunction or breakdown.

FIG. 12 shows one of the conventional electrical connectors having a mechanism for protecting electronic circuits from electrostatic damage. A plug connector 15 is secured to a cable 30 having a shield wire 31 and lead wires 32. This plug connector has at the front end a plug unit 16 having contacts therein and a plug case 17 made of metal and attached to the back of plug unit 16. A receptacle connector 20 is secured to the housing of an electronic system 40. It has at its front end a receptacle unit 21 having contacts therein and a receptacle case 22 made of metal and attached to the back of plug unit 21.

As a protective means against electrostatic damge, a lead wire 33, which has been connected to the shield wire 31, is connected to the housing of electronic system 40 with a screw 45 or the like, while the shield wire 31 is secured to the plug case 17. A lead wire 42 connects the receptacle case 22 of receptacle connector 20 to the housing of electronic system 40. Reference numeral 41 denotes an electronic circuit connected to the contacts of receptacle connector 20.

With such a structure, even if a person having static electricity holds the plug connector 15 and inserts it into the receptacle connector 20, the static electricity is grounded through the shield wire 31, lead wire 33, and the housing of electronic system 40 so that it has no adverse effects on the electronic circuit 41.

There are many mechanisms for locking the connection of these connectors. For example, Japanese U.M. Patent Publication No. 53-47580 discloses a mechanism having a locking member fitted into the connector case for easy attachment and detachment without using a bolt. This mechanism will be described in connection with the accompanying drawing, wherein FIG. 13 is a perspective view of the locking member; FIG. 14 is an elevational section showing the locking member installed in a connector housing in which the locking members are fitted, and FIG. 15 is a sectional view taken along the line 15—15 of FIG. 14.

As FIGS. 14 and 15 shows, this conventional boltless connector locking mechanism has a pair of locking members 1. This locking member has at one end a hook-like engaging portion 2 and at the other end a pushing portion 3. It is provided at opposite sides with a pair of resilient strips 4 and 4' made of a flexible material. As shown, these resilient strips are made integral with but narrower than the locking member 1 so that they may be more flexible than the locking member. A reinforcing rib 5 is provided in the locking member 1 so that the locking member may be more rigid than the resilient strips. The case is made up of two case halves 6 and 6', each having a pair of pockets 7 and 7' into which the front ends of resilient strips 4 and 4' are fitted.

When each locking member 1 is installed in the case by inserting the resilient strips 4 and 4' into the pockets 7 and 7', the hook portion 2 engages a lockpiece 8 (8') while the pushing portion 3 is exposed through a window 9. In FIG. 13, when the pushing portions 3 are pinched inward into the window 9, the resilient strips 4 and 4', the front ends of which have been fitted into the pockets 7 and 7', are bent between the fitted portions and joints 10 and 10' so that the hook portions 2 move outward and disengages from the lock pieces 8 and 8', thus releasing the connector lock.

However, such conventional electrical connectors have the following problems: In FIG. 12, the plug connector 15 is secured mechanically as well as electrically to the electronic system 40 through the lead wire 33 so that its handling has been very inconvenient. Especially, when the plug connector 15 is to be connected to another receptacle connector, the screw 45 must be loosened to remove the lead wire 33, and then the plug connector is connected to another receptacle by screwing the lead wire 33 to the other system. In addition, when the plug connector 15 is disconnected from the receptacle connector 20 when they are not used, the lead wire 33 bears the combined weights of plug connector 15 and cable 30 and can be broken by accident.

In FIGS. 13 and 14, the hook-like end 2 of locking member 1, which is installed in the vicinity of the opening of the case 6 and 6' and free to move inward within the case in FIG. 14, can be bent toward inward by an external force applied upon connection. If the hook portion 2 is engaged with or disengaged from the locking piece 8 or 8' by an undue force, it can be deformed. Such bending or deformation will result in a defective connection between plug and receptacle connectors.

SUMMARY OF THE INVENTION

Accordingly, it is an object of the invention to provide a locking mechanism for electrical connectors that is free from the afore-mentioned problems.

According to one aspect of the invention there is provided a mechanism for locking the connection between a first electrical connector having a first insulating housing with contacts therein and a conducting connector case surrounding said insulating housing and a second electrical connector having a second insulating housing with contact therein, characterized by a locking member extending along at least one side of said first electrical connector between said insulating housing and said conducting case; a first connection member fitted between said insulating housing and said locking member for protecting said locking member against physical damage and electronic equipment against electrostatic damge; a second connection member provided on the insulating housing side of said second electrical connector corresponding to said first connector side on which said locking member and the connection member are mounted; said locking member made of a resilient material and having a first locking portion at the front end a pushing portion at the rear end, and a fulcrum portion between them; said pushing portion exposed through said connector case so that the operator may push it; said fulcrum portion supported between said conducting case and said insulating housing so that said locking portion may be resiliently moved apart from said first connector side when said pushing portion is pressed; said first connection member made of a conducting material so as to make an electrical connection with said conducting case and having a protective portion projecting beyond the front end of said contacts in said insulating housing for not only preventing said locking member from inward movement but also protecting it from physical damge; said protective portion permitting said locking portion to come more inward than said locking member; said second connecton member made of a conducting material so as to make a grounding connection and having the front end placed in the vicinity of the front ends of contacts in said insulating housing and at said front end a second locking portion to engage said first locking portion of said locking member for locking the connection of said electrical connectors.

According to the invention, the first connection member for protecting the locking member from physical damage and electrical equipment from electrostatic damage is placed inside the locking member for checking the inward displacement of the locking portion and preventing deformation of the locking portion. When the first connector is connected to the second connector, its front end comes into contact with the front end of the second connection member before any electrical contact occurs between these connectors so that the static electricity on the first connector is grounded through the second connection member of the second connector, whereby protecting the electrical circuit from electrostatic damage.

According to another aspect of the invention there is provided a mechanism for locking the connection between first and second electrical connectors, characterized by a locking member extending along at least one side of said first electrical connector; protective means provided on said side for protecting said locking member; and locking means provided on the side of said second electrical connector corresponding to said locking member and protective means for receiving said locking member; said locking member made of a resilient material and having a locking portion at the front end, a pushing portion at the rear end, and a fulcrum portion between them; said fulcrum portion supported on said side of said first electrical connector so that said locking portion may be resiliently moved apart from said first connector side when said pushing portion is pressed; said protective means having a protective protion for limiting the inward movement and providing mechanical protection of said locking portion of said locking member; said protective portion permitting said locking portion to come more inward than said locking member; said locking means engageable with said locking portion of said locking member for locking the connection of said electrical connectors.

Other and further objects, features and advantages of the invention will appear more fully from the following description in connection with the accompanying drawings.

BRIEF DESCRIPTION OF THE DRAWING

FIG. 12 is a schematic diagram of the conventional connector mechanism with a protective device against electrostatic damge.

FIG. 13 is a perspective view of the conventional locking member.

FIG. 14 is a sectional view of the conventional connector with the locking member of FIG. 13.

FIG. 15 is a sectional view taken along the line 15—15 of FIG. 14.

DESCRIPTION OF THE PREFERRED EMBODIMENTS

Figure 1:
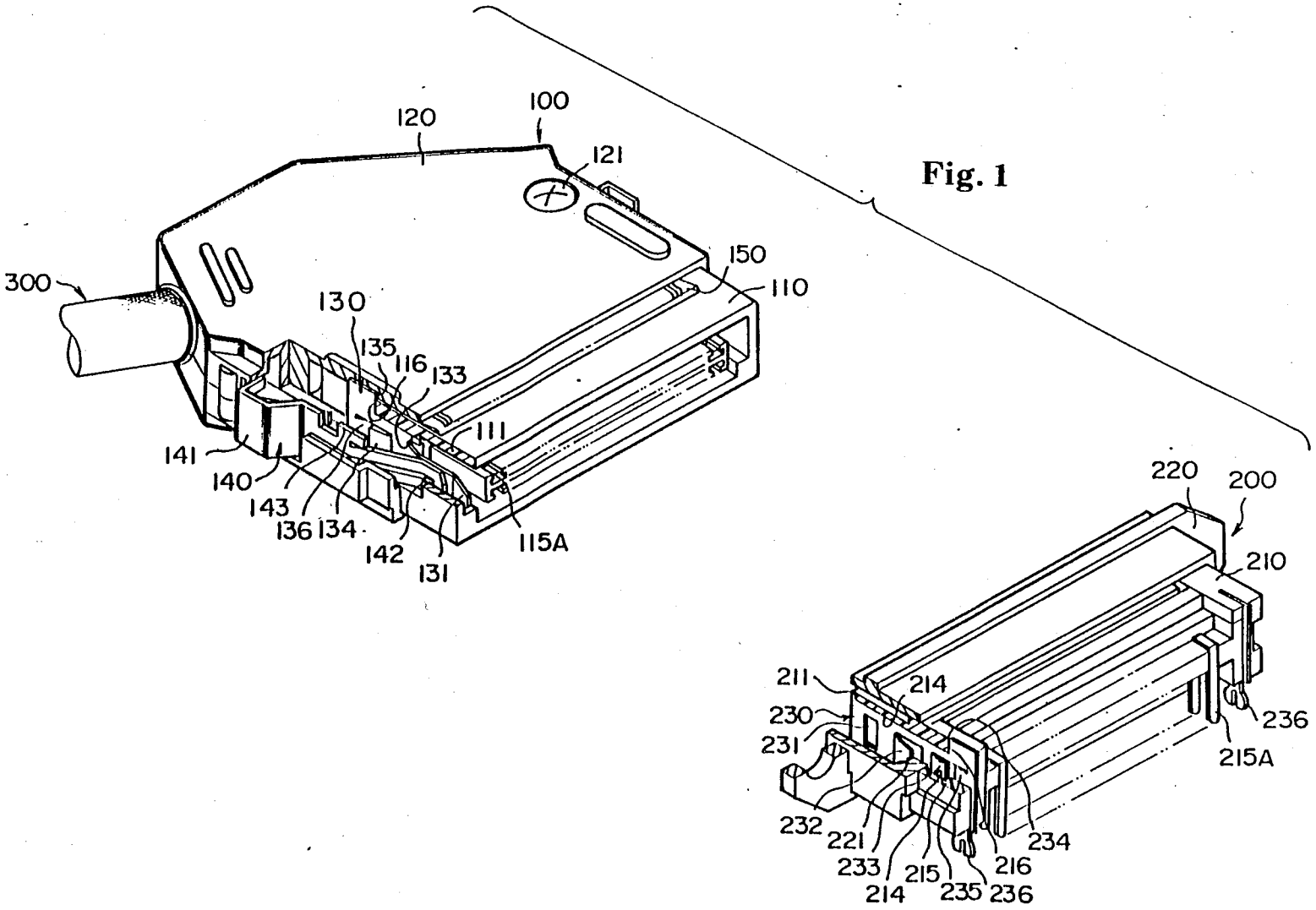
FIG. 1 is a perspective view, broken in part, of a plug connector and a receptacle connector embodying the present invention.

Referring now to FIG. 1 there is shown a plug connector 100 and a receptacle connector 200 embodying the present invention. The plug connector 100 consists mainly of a male insulating housing 110 having male contacts therein and a plug case or conducting shield case 120 that surrounds most of the insulating housing 110. The plug case halves 120 are joined together with a screw 121 so as to sandwich the insulating housing 110.

The receptacle connector 200 consists mainly of a female insulating housing 210 having female contacts therein and a receptacle case of conducting shield case 220 surrounding the female insulating housing. The receptacle case 220 is secured to the housing of an electronic system (not shown) with a screw or the like for grounding.

A pair of protective means or male connecting members 130 are provided at opposite sides of male insulating housing 110 so as to make a grounding conection before both plug and receptacle connectors 100 and 110 make any electrical connection. A pair of locking members 140 are placed outside the connecting members 130 so as to engage the locking means of the other party for locking. The locking members 140 are sandwiched between the plug case halves 120. A pair of grounding plates 150 are provided on opposite sides of male insulating housing 110. A part of each grounding plate 150 is sandwiched between the plug case 120 and the male insulating housing 110 so as to come into contact with the plug case 120 while the rest of the grounding plate is exposed on the male insulating housing 110.

A pair of locking means or female connecting members 230 are provided at opposite sides of female insulating housing 210 so as to make a grounding connection before the plug and receptacle connectors 100 and 200 make any electrical connection. The rear portion of each female connecting member 230 comes into contact with the receptacle case 220 for grounding.

Figure 2A:
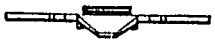
FIGS. 2 (A), (B), and (C) are a plan view, an elevational view, and a side view of a male connection member of the plug connector.
Figure 2B:
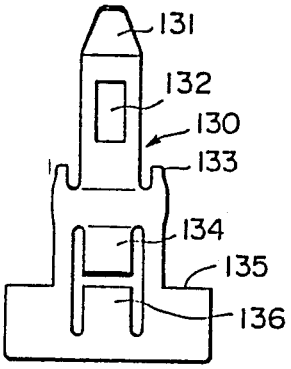
Figure 2C:
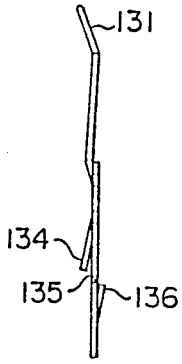
Figure 3A:
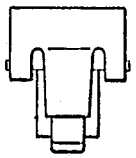
FIGS. 3 (A), (B), and (C) are a plan view and an elevational view of a locking member of the plug connector, and a sectional view taken along the line 3C—3C of FIG. 3 (B).
Figure 3B:
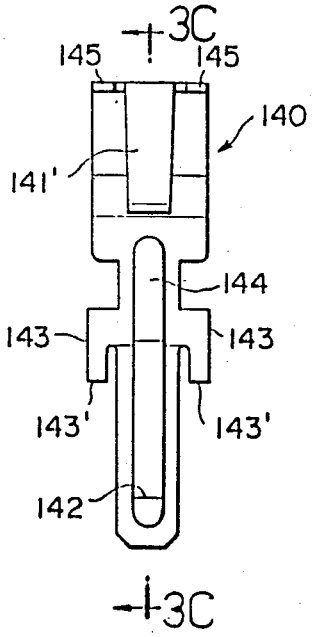
Figure 3C:
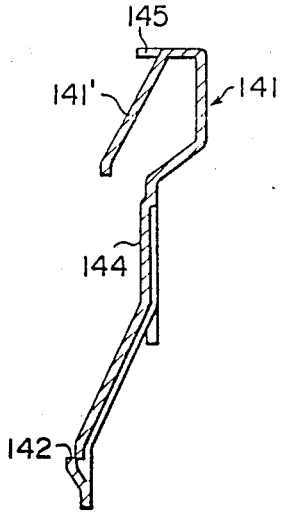
Figure 4:
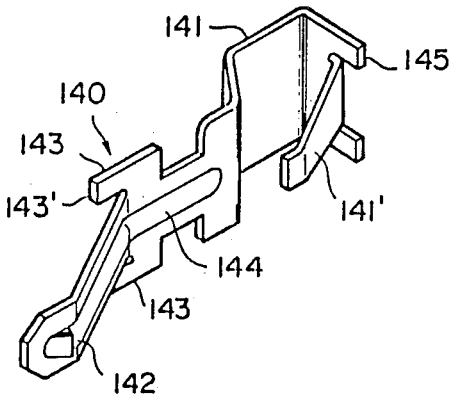
FIG. 4 is a perspective view of the locking member.

FIGS. 2 (A), (B), and (C) are a top view, an elevational view, and a side view of the male connection member 130; FIGS. 3 (A), (B), and (C) are a top view, an elevational view, and a sectional view taken along the line 3C—3C of FIG. 3 (B) of the locking member 140; FIG. 4 is a perspective view of the locking member 140; and FIGS. 5 (A), (B), and (C) are a top view, an elevational view, and a side view of the female connecting member 230.

Figure 7:
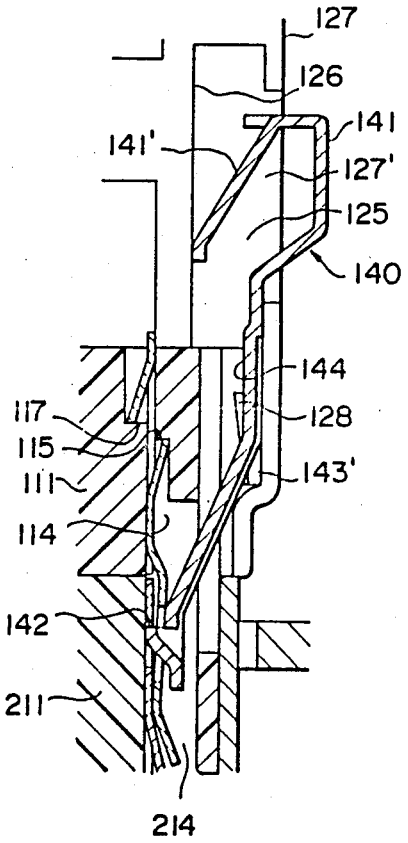
FIG. 7 is an enlarged view showing the male connection member and the locking member fitted in the plug connector.

As best shown in FIG. 2, the male connecting member 130 is stamped out of a resilient metal sheet so that it has a springy property. The front end 131 of male connecting member 130 is tapered and bent outward so as to ease reception of the front end of female connecting member 230. Provided below the front end 131 is a rectangular opening 132 to receive a locking projection 142 of locking member 140. Provided below and at opposite sides of the rectangular opening 132 are a pair of projections 133 to fit into a pair of recesses 114 of insulating housing 111 (FIG. 7). Provided below the projections 133 is a stopper portion 134 to engage a stepped portion 115 in the recess 114 of insulating housing 111 for keeping the male connecting member 130 from falling off from the rear side. Provided at the rear end of male connecting member 130 are a shoulder 135 to engage a stepped portion 116 (FIG. 1) for keeping the male connecting member 130 from falling off from the front side and a locking portion 136 to engage the stepped portion 117 of insulating housing 111.

Figure 8:
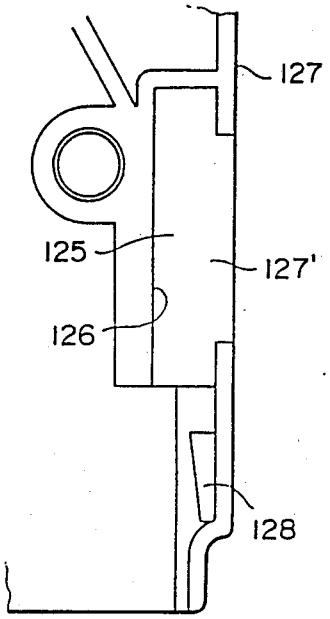
FIG. 8 is an enlarged view showing a cavity of the plug case for receiving the locking member.

As best shown in FIGS. 3 and 4, the locking member 140 is stamped and bent out of a springy metal sheet. A substanially U-shaped pushing portion 141 is formed at the top. The locking portion 142 is formed at the bottom. Provided between the pushing portion 141 and the locking portion 142 are a pair of supporting portions 143, each having a fulcrum portion 143', which is fitted into a recess 128 of plug case 120 (FIG. 8). An elastic tongue 141' is provided at the back of pushing portion 141 to bias the pushing portion 141 outward and the locking portion 142 inward about the fulcrum 143'. When the pushing portion 141 is pushed inward against the bias of resilient tongue 141', the locking portion 142 turns outward about the fulcrum 143' releasing itself from the locking portion of the other connectors. A reinforcing rib or grooved deformation 144 is provided lengthwise in the center of locking member 140 below the pushing portion 141. The intermediate part below the supporting portion 143 has a narrow width and is bent inward at the supporting portion 143. The lower end of reinforcing rib 144 is protruded toward inside to form a locking portion 142. A pair of stoppers 145 is provided at the back of pushing portion 141 so that when the pushing portion is pressed, they abut the wall 126 of a cavity 125 (FIG. 8) to prevent further inward movement of the pushing portion.

As best shown in FIGS. 7 and 8, the locking member 140 is sandwiched between the two parts of connector case 120. A pair of cavities 125 are defined at opposite sides in one of the two case parts for receiving the locking members 140. This cavity has a wall 126 against which the tip of resilient tongue 141' abuts and its further movement is prevented. On the side wall 127 there is provided a window 127' through which the pushing portion 141 is exposed. A pair of recesses 128 are provided on the wall 127 to receive the fulcrum portions 143' of locking member 140. To assemble the case 120, a pair of locking members 140 are fitted into the cavities 125 and covered with the other case part 120 so that the pushing portions 141 may exposed through the windows 127'.

Figure 5A:
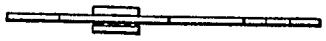
FIGS. 5 (A), (B), and (C) are a plan view, an elevational view, and a side view of a female connection member of the receptacle connector.
Figure 5B:
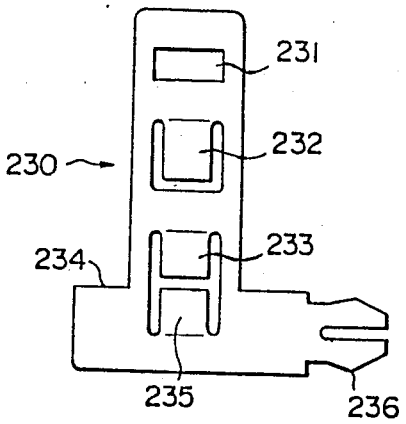
Figure 5C:
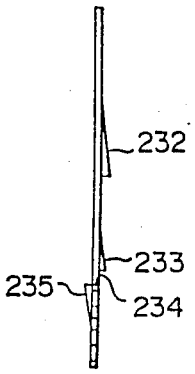

FIGS. 5 (A), (B), and (C) illustrate a female connection member 230 having an L-shape. Similarly to the male connection member 130, this female connection member may be made by stamping a springy metal sheet. A locking opening 231 is provided at the front end of female connection member 230 for engaging the locking portion 142 of locking member 140. A case locking portion 232 is provided below the locking opening 231 to engage the engaging step 221 (FIG. 1) of receptacle 220 for locking the case 220. The case locking portion also serves as a contact for making an electrical connection with the case 220. A stop portion 233 is provided at the intermediate portion of female connection member 230 to engage the stopper step 215 in the cavity 214 of insulating housing 211 (FIG. 1) for preventing this female connection member from falling off from the rear side.

The rear end portion of L-shaped female connection member 230 is provide with a shoulder 234 to engage a stopper step 216 in the cavity 214 of insulating housing 211 (FIG. 1) for preventing the female connection member from falling off from the front side. A locking portion 235 is provided in the middle of the rear end portion to engage the locking step of insulating housing 211 for locking. A leg 236 is provided at the front end of the rear portion to be inserted into a hole of a circuit board. As best shown in FIG. 1, a pair of such female connection members 230 are provided at opposite sides of receptacle connector 200 for mounting on a printed circuit board (not shown). As has been described above, the receptacle case 220 is secured to the housing of an electrical system with a fastener such as a screw.

Figure 6:
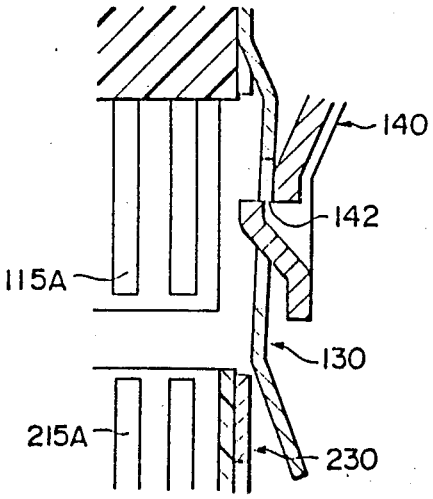
FIG. 6 is an enlarged view showing the male and female connection members just before the plug and receptacle connectors are connected.

When a person charged with static electricity holds the plug connector 100 to insert it into the receptacle connector 220, the plug connector is charged with the static electricity. As FIG. 6 shows, before contact between the contact 115A of plug connector 100 and the contact 215A of receptacle connector 200, the front end of male connection member 130 of the plug connector and the front end of female connection member 230 of the receptacle connector make an electrical contact so that the static electricity on the plug connector is grounded through the receptacle connector and the housing by a spark or the like between the male and female connection members. Even if the plug connector is connected or disconnected by an excessive force, the locking portion 142 of locking member 140 is placed in the opening 132 of male connection member 130 to prevent its inward movement and protected from physical damage such as deformation, bending, or flexure.

Compared with the prior art, the locking mechanism for electrical connectors according to the invention has the following advantages:

(1) Since the male and female connection members 130 and 230 work together, there is no need for an external lead wire connected to prevent electrostatic damage to electronic equipment. Without any external lead wire, the plug and receptacle connectors can be separated completely, and the plug connector can be connected to another receptacle connector as an ordinary electrical plug, thus making the connector exchange very easy.

(2) Since no external leads is necessary, this plug connector, which has a protective function for electronic equipment from electrostatic damge, can be stored in another place without difficulty when it is not used.

(3) The male connection member 130 is placed just inside the locking member 140 to prevent not only inward movement of the locking member but also deformation of the locking portion otherwise made by an external force. As a result, even if the plug and receptacle connectors are connected or disconnected with an excess external force, the locking portion would not be deformed, bent, or biased.

(4) The single male connection member 130 can provide protection against both physical damage to the locking portion and electrostatic damage to electronic equipment so that the locking mechanism is simple and inexpensive.

Figure 9:
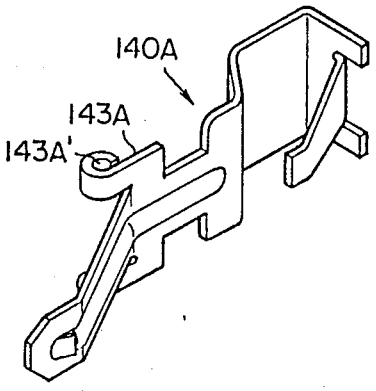
FIG. 9 is a perspective view of another locking member for the connection locking mechanism embodying the present invention.

FIG. 9 illustrates another locking member 140A embodying the present invenion. This locking member has a support tongue 143A with its tip curved to form a annular fulcrum 143A'. The other parts are identical with those of FIG. 4. This annular fulcrum is fitted over a fulcrum stud provided at the cavity wall of plug connector case 120 for more stable rotation of the locking member.

Figure 10:
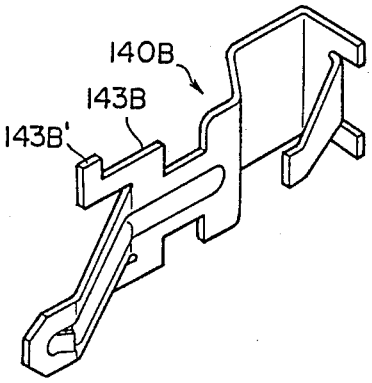
FIG. 10 is a perspective view of a still other locking member for the connection locking mechanism embodying the invention.

FIG. 10 shows still another locking member 140B embodying the invenion. This locking member has an outwardly projected fulcrum 143B' at the front end of support tongue 143B. The other parts are identical with those of FIG. 4. This projected fulcrum is fited in a recess provided on the cavity wall of plug connector case 120. This recess is simpler and smaller than the flucrum recess 128 of the afore-mentioned embodiment as best shown in FIG. 8, thus making its workability higher and the operation of the lockng member better.

Figure 11:
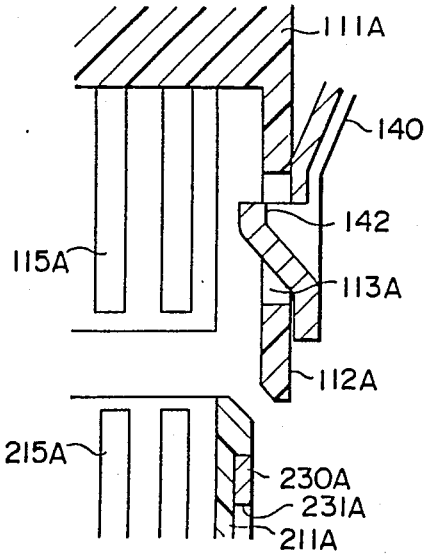
FIG. 11 is a patial section of a locking member protective means embodying the invention.

FIG. 11 illustrates in section yet another locking member embodying the present invention. In each of the aobve embodiments in FIGS. 1 through 8, the member for protecting the locking member is made of a male connection member 130, but in this embodiment, a protective wall 112A is provided integrally with the insulating housing 111A of connector 100. This protective wall 112A has an opening 113A into which the locking portion 142 of locking member 140 is placed. With this structure, the aforementioned separate connection member 130 can be omitted, thus reducing the manufacturing cost.

Moreover, a connection member 230A having a locking opening 231A, with which the locking portion 142 engages, may be integrated with the insulating housing 211A so that an expensive resilient metal connection member 230A can be omitted, thus reducing the manufacturing cost.

According to the invention, a locking member protective means is provided inside the locking member of an electrical connector to prevent not only the locking portion of the locking member from moving inward beyond a certain limit but also an external impact or excess force from being applyied to the locking portion, thus preventing deformation of the locking portion.

Although the preferred embodiments of the present invention have been described above, other embodiments and modifications which would be apparent to one having ordinary skill in the art are intended to be covered by the sprit and scope of the appended claims.

What is claimed is:

1. A mechanism for locking the connection between a first electrical connector having a first insulating housing with contacts arranged therein and a conducting connector case surrounding said first insulating housing and a second electrical connector having a second insulating housing with contacts arranged therein, which comprises:

a locking member extending along at least one side of said first electrical connector between said first insulating housing and said conducting case;

a first connection member fitted between said first insulating housing and said locking member for protecting said locking member against physical damage and electronic equipment against electrostatic damage;

a second connection member provided on the insulating housing side of said second electrical connectior corresponding to said first connector side on which said locking member and the connection member are mounted;

said locking member made of a resilient material and having a first locking portion at the front end, a pushing portion at the rear end, and a fulcrum portion between them;

said pushing portion exposed through said connector case so that the operator may push it;

said fulcrum portion supported between said conducting case and said first insulating housing so that said locking portion may be resiliently moved apart from said first connector side when said pushing portion is pressed;

said first connection member made of a conducting material so as to make an electrical connection with said conducting case and having a protective portion projecting beyond the front end of said contacts in said first insulating housing for not only preventing said locking member from inward movement but also protecting it from physical damage;

said protective portion permitting said locking portion to come more inward than the rest of said locking member;

said second connection member made of a conducting material so as to make a grounding connection and having a front end placed in the vicinity of front ends of said contacts in said second insulating housing and having a second locking portion to engage said first locking portion of said locking member for locking the connection of said electrical connectors.

2. A mechanism for locking the connection of electrical connectors as recited in claim 1, wherein said locking member is electrically conducting and electrically connected to said connector case.

3. A mechanism for locking the connecton of electrical connectors as recited in claim 1, which further comprises:

a window provided on said connector case side, through which said pushing portion of said locking member is exposed; and a recess provided on the inside of said connector case for receiving said fulcrum portion of said locking member.

4. A mechanism for locking the connection of electrical connectors as recited in claim 1, wherein said protective portion of said first connection member is tapered so as to ease its reception of the front end of said second connection member.

5. A mechanism for locking the connection of electrical connectors as recited in claim 1, which further comprises a second conducting connector case surrounding said second insulating housing and electrically connected to said second connection member.

6. A mechanism for locking the connection between first and second electrical connectors, which comprises:

a locking member extending along at least one side of said first electrical connector;

protective means provided on said side for protecting said locking member;

locking means provided on the side of said second electrical connector corresponding to said locking member and protective means for receiving said locking member;

said locking member being made of a resilient material and having a locking portion at the front end, a pushing portion with a spring tongue at the rear end, and a pair of fulcrum portions between them;

said side of said first electrical connector has a cavity defined by an outer wall having a window through which only said pushing portion of said locking member is exposed and an inner wall against which said spring tongue abuts and having a pair of fulcrum supports on which said fulcrum portions are supported;

said protective means having a protective portion for limiting the inward movement of said locking portion so that when said pushing portion is depressed, said locking portion may move away from said locking means for release but only within a space between said outer wall and said protective portion; and said protective portion permitting said locking portion to come more inward than the rest of said locking member so that said locking portion may engage with said locking means for locking the connection of said electrical connectors.

7. A mechanism for locking the connection between first and second electrical connectors as recited in claim 6, wherein each said fulcrum portion is a tongue-shaped fulcrum and said side of said first electrical connector is provided with a recess for receiving said tongue-shaped fulcrum.

8. A mechanism for locking the connection between first and second electrical connectors as recited in claim 6, wherein each said fulcrum portion is a annular fulcrum and said side of said first electrical connector is provided with a stud for fitting into said annular fulcrum.

9. A mechanism for locking the connection between first and second electrical connectors as recited in claim 6, wherein each said fulcrum portion is a projected fulcrum and said side of said first electrical connector is provided with a recess for receiving said projected fulcrum.

10. A mechanism for locking the connection between first and second electrical connectors as recited in claim 6, wherein said protective means is an independent member attached to said side of said first electrical connector.

11. A mechanism for locking the connection between first and second electrical connectors as recited in claim 6, wherein said protective means is integrated with a housing of said first electrical connector.

12. A mechanism for locking the connection between first and second electrical connectors as recited in claim 6, wherein said locking means is a connection member with an opening attached to said side of said second electrical connector.

13. A mechanism for locking the connection between first and sectond electrical connectors as recited in claim 6, wherein said locking means is a connection member with an opening, which is integrated with said side of said second electrical connector.

14. A mechanism for locking the connection between first and second electrical connectors as recited in claim 12, said protective portion of said protective means is tapered so as to ease insertion of the front end of said connection member.

15. A mechanism for locking the connection between first and second electrical connectors as recited in claim 14, wherein said protective portion of said protective means has an opening for permitting said locking portion of said locking member to be present inside of said protective portion.

* * * * *